United States Patent [19]

Toda et al.

[11] 4,449,563

[45] May 22, 1984

[54] COUNTERBALANCE SYSTEM FOR SAGGING ROTATING ELEMENT

[75] Inventors: Minoru Toda; Susumu Osaka, both of Tokyo, Japan

[73] Assignee: RCA Corporation, New York, N.Y.

[21] Appl. No.: 382,200

[22] Filed: May 26, 1982

[51] Int. Cl.[3] ..... E05D 15/18

[52] U.S. Cl. ..... 160/184; 49/74

[58] Field of Search ..... 160/166, 184; 49/31, 49/21-23, 74; 16/1 C, DIG. 8, DIG. 16, 194

[56] References Cited

U.S. PATENT DOCUMENTS

| | | | |
|---|---|---|---|
| 3,211,264 | 10/1965 | Streeter | 160/107 |
| 3,604,458 | 9/1971 | Silvey | 49/74 |
| 4,058,025 | 11/1977 | Wood | 16/DIG. 8 |

*Primary Examiner*—Peter M. Caun
*Assistant Examiner*—Cherney S. Lieberman
*Attorney, Agent, or Firm*—Joseph S. Tripoli; George E. Haas; William Squire

[57] ABSTRACT

A slat rotatably supported at its ends has its mass center offset from the axis due to sag. A spring biased mass is attached to the slat for creating a torque when the slat is rotated which counterbalances the torque created by the offset slat mass center to minimize the drive force required to rotate the slat.

10 Claims, 8 Drawing Figures

COUNTERBALANCE SYSTEM FOR SAGGING ROTATING ELEMENT

The present invention relates to a counterbalancing system for cancelling the torque created by a rotating sagging element whose mass is offset by the sag from the axis of rotation of the element.

One example of a rotating element which exhibits sag is a slat employed in a conventional shutter. Shutter slats usually are plane or curved sheet metal material rotatably driven to open and close an opening. Such slats are usually sufficiently strong and rigid so as to exhibit negligible sag regardless the angular orientation of the slat. However, automated systems, which include shutters are now being made available for commercial application.

To automate a shutter system may require the shutters be opened and closed by an electrically operated system. Energy costs, however, are escalating and it is desirable therefore to minimize the power requirements for operating such a system. One way of minimizing the power required is to reduce the load, i.e., the weight of the individual slats. This weight reduction is achieved by making the slats of extremely thin sheet material such as 50 micron thick aluminum foil. Slats formed of such material may be strengthened somewhat by the addition of ribbing, for example, creases or bends which run the length of the slat. However, even with ribbing, the length of the slat between supports is limited due to the bending or sag at the central portion when the slat is generally horizontal, i.e., the large surface area of the slat is horizontal and perpendicular to the force of gravity.

In shutter constructions the slats normally are rotatably driven at their ends by cranks, levers, and so forth. In these implementations the slats are supported at their ends by pivot bearings. While it is desirable to make a shutter, in some cases, large enough to fit relatively large openings, the shutter slats are limited in their length dimension due to the presence of sag.

A further load factor is produced by the slat sag. The torque created by the offset mass center of each of the slats when rotated about their respective axes tends to increase the load on the drive power. This increased load is especially undesirable where it may be required that the shutter assembly be battery operated or solar-power operated.

In a structure embodying the present invention, an element is included which tends to bend in a given direction in response to the force of gravity on the mass center of the element. Means are included for rotatably supporting the element between two spaced points for rotation about an axis passing through the mass center of the element in the unbent state. The bent element mass center is offset from the axis. The offset mass center due to gravity produces a first torque about the axis when the element is rotated about the axis. A counter torquing means secured to the element creates, as the element is rotated, a second torque equal and opposite in sense to the first torque.

Figures 1, 2, 3:
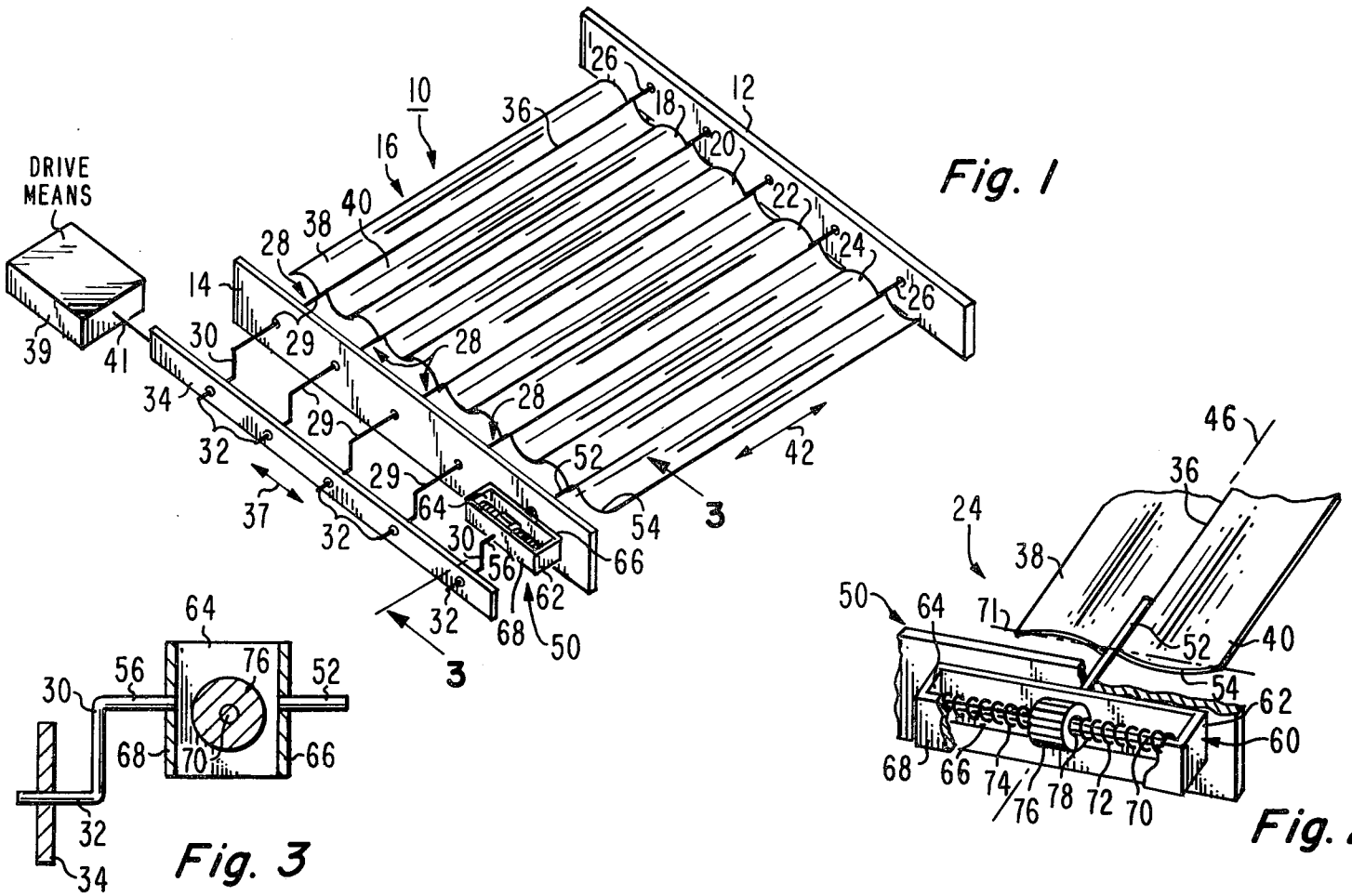
FIG. 1 is an isometric view of a shutter construction in accordance with one embodiment of the present invention.
FIG. 2 is an isometric fragmented view showing more detail of a portion of the structure of FIG. 1.
FIG. 3 is a sectional view through a portion of the structure of FIG. 1 taken along lines 3—3.

In FIG. 1 a shutter construction 10 comprises two support members 12 and 14 which may be parallel sheet metal members secured to a frame (not shown) and which remain stationary. A plurality of parallel slats 16, 18, 20, 22, and 24 of identical construction are pivotally secured at the longitudinal ends to the support members 12 and 14. For example, slat 16 is pivotally secured at one longitudinal end to support member 12 by a straight shaft 26 and at the opposite end to support member 14 by crank 28. Crank 28 has a pivot shaft 29, a crank arm 30 and a drive leg 32 which is pivotally mounted to crank lever 34. Shaft 29 passes through and is free to rotate within member 14. The axis of rotation of leg 32 is offset from the axis of rotation of the slat 16 about shaft 29 by the length of crank arm 30. Slats 18, 20, and 22 have an identical shaft 29. Slat 24 has an equivalent shaft formed of shafts 52 and 56 attached to device 50 which will be explained in more detail later.

Figure 5:
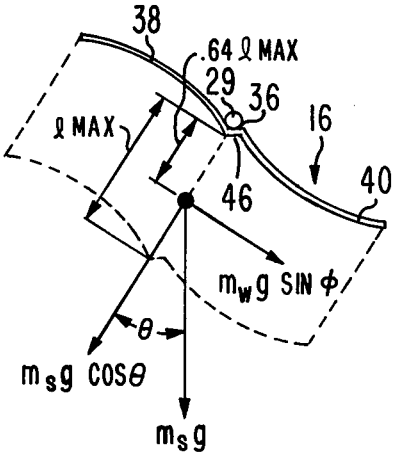
FIGS. 5 and 6 are diagrams useful in explaining the principles of the present invention.

The slat 16 may be a shutter formed of thin material, for example, 50 micron thick aluminum sheet material which is relatively flexible and lightweight. Slat 16 has two sharp bends forming a step 36 running along its central longitudinal axis and aligned with shafts 26 and 29. The step 36 forms a rib and tends to strengthen the slat. The slat 16 has a curved portion 38 on one side of the step 36 and whose convex surface faces in one direction and a second curved portion 40 on the other side of the step 36 and whose concave portion faces in the same direction as the convex surface of portion 38. Together the portions 38 and 40 form a modified S-shape configuration in end view as shown in FIG. 5 for slat 16. All of the slats 16–24 are constructed in identical fashion from identical materials but may be, in some implementations, of different constructions. All of the cranks 28 and shafts 26 may be identically secured to their corresponding slats such as by an adhesive (not shown).

The shafts 26 and 29 lie on the axis of rotation of the slat 16. Similarly, the corresponding shafts of each of the remaining slats lie on the axis of rotation of that slat. All of these axes of rotation are parallel. Legs 32 of all of the cranks 28 are also aligned parallel to the slats and pivotally secured to crank lever 34. Crank lever 34 is driven in directions 37 by a drive means 39 which may be an air-operated cylinder, cam-operated motor, piezoelectric device, or any other suitable power source. Movement of the crank lever 34 in directions 37 by drive link 41 causes the respective slats to rotate about their corresponding axis formed by the shafts 26, 29.

The length of the slats in directions 42 between shafts 26, 29 is such that the slats may sag in their central regions. This is shown more particularly in FIG. 4 in which slat 16 when supported at its ends at 44, 45 tends to sag a distance $l_{max}$ from axis 46 when the slat broad surface represented by portions 38, 40 is generally horizontal. When the slat is oriented 90° from the position of FIG. 4 so that its broad surface is generally vertical, the relatively wide width of the slat tends to form a wide beam vertically oriented and this minimizes the sag to a low or zero value. The shafts 26, 29, FIG. 1, of the slat 16 are aligned on axis 46. However, due to the weight of the slat 16, its mass center being centrally positioned between the ends 44 and 45, tends to sag a maximum distance from axis 46 at the slat center. This sagging mass center, when rotated, tends to create a torque as will be explained more fully later. This torque ordinarily needs to be overcome by the drive means 39 of FIG. 1 as it rotates the slats.

Device 50, FIG. 1, is attached to one of the slats such as slat 24 to counterbalance the torques produced by each of the offset mass centers caused by the slat sag of each slat as those slats are rotated about their respective axes. Device 50 is attached to shaft 52 at end 54 of slat 24. Shaft 52 passes through support member 14 and is pivotally supported by the support member 14. In line with the shaft 52 is a second shaft 56 both of which lie on the axis of rotation of the slat 24. Attached to shaft 56 is crank arm 30 and leg 32 which are identical in dimension and orientation with respect to the crank arms 30 and legs 32 on the remaining cranks 28. The device 50 is fixed between the shafts 52 and 56 and rotates with these shafts.

Figure 4:
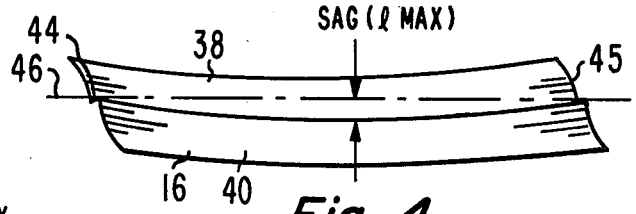
FIG. 4 is an isometric view of a portion of a slat illustrating sag.

In FIG. 5, the problem created by a sagging slat is illustrated in more detail. Slat 16 is shown in solid with its sagging central portion shown dashed. As stated above, the maximum displacement of the central portion of the slat between its ends 44, 45, FIG. 4, is $l_{max}$. The slat 16 is rotated about its axis 46, for example, clockwise in FIG. 5, so that it is tilted through an angle $\theta$. The torque required to keep the slat at angle $\theta$ is $(0.64\ l_{max})\ m_s g \sin\theta$, where $l_{max}$ is the value of the deviation or sag of the slat at the central region, the value 0.64 is determined by the location of the slat mass center, g is the gravity acceleration of 9.8 newton/kg and $m_s$ is the total mass of the slat. This can be shown from the analysis of a beam supported at its ends subject to an evenly distributed force which tends to bend the beam. The value of $l_{max}$ varies in accordance with the angle $\theta$. When the broad surface of the slat 16 is horizontal ($\theta=0$), $l_{max}$ is a maximum. When that broad surface is vertical ($\theta=90°$), $l_{max}$ is a minimum or zero. This latter condition is due to all of the weight passing through the broad width dimension of the slat which forms a relatively wide vertical beam preventing sagging of the slat in that vertical orientation as explained above. Generally, $l_{max}$ is proportional to $\cos\theta$ since the force component normal to the broad surface of the slat is $m_s g \cos\theta$. This is the force component that causes the displacement or sagging of the slat which is normal to the broad surface of the slat. It is to be understood that the broad surface includes the area of the portions 40 and 38. The torque produced by the displaced or sagging mass center of the slat thus is $0.64\ l_{max}\ m_s g \sin\theta$. Since as described above $l_{max}$ is a function of the $\cos\theta$ the torque is therefore a function of the $\cos\theta$ sine $\theta$ and this is proportional to $\frac{1}{2}\sin 2\theta$. Therefore, the angle dependence of the torque is $\sin 2\theta$. As provided in accordance with the present invention, the torque produced by the displaced or sagging mass of the slat can be cancelled by another mass and the counter torque produced by that mass.

However, it is important to note that a $\sin 2\theta$ function represents a two-cycle variation of a change in torque when $\theta$ varies from 0° to 360°. Normally a fixed off center mass presents a one-cycle variation of torque during a change of rotation of the angle $\theta$ from 0° to 360°. Therefore, to provide simply an offset mass to counterbalance the torque produced by the sagging mass of the slat would be insufficient. To meet this problem, the device 50, FIG. 2, is provided.

The device 50 provides a counterbalance torque which is proportional to $\sin 2\theta$ and produces a torque substantially equal and opposite to the torque produced by the sagging slat masses. In FIG. 2 the device 50 comprises a frame 60 which is a box-like element having two end walls 62 and 64 and two side walls 66 and 68. A shaft 70 is fixed to end walls 62 and 64 and crosses the axis of rotation 46 of the slat 24 and extends generally parallel to the broad surface area of the slat. Two identical compression springs 72 and 74 pass over the shaft 70. A mass 76 which may be equal to the mass of the combined masses of the slats 16–24 or some other value is mounted over the shaft 70 between the two springs 72 and 74. The mass 76 has a central hole 78 which permits the mass to slide freely over the shaft 70. The mass 76 does not have to be equal to the total weight of the mass of all the slats, but the torque produced by the mass 76 should be equal to that produced by the offset masses of all of the slats. In other words, if weak springs 72, 74 are used, a smaller mass is sufficient because of the relatively large displacement of the mass. For strong springs, a relatively larger mass would be used, remembering that torque T is (force F)×(arm length l). This will be explained more fully later. The center of the mass 76 remains on the shaft 70 as it slides. Springs 72 and 74 are sufficiently long so as to be always compressed regardless the position of the mass 76 on shaft 70 and therefore resiliently urge the mass 76 centrally on the axis 46. Mass 76 is intended to produce a torque which counterbalances the torques produced by the offset masses of all of the slats. Mass 76 is shown as a right circular cylindrical member with a hollow core at 78. The mass could take other shapes, as well. What is important is that the mass 76 be symmetrical with respect to the surfaces abutting the springs 72 and 74, and that its mass center be centered between those abutting surfaces so that its mass center is aligned on the axis 46, FIG. 2, when the shaft 70 is horizontal (and the slats are horizontal).

Figure 6:
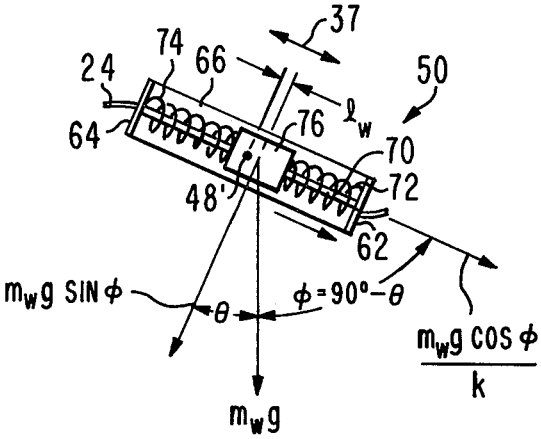

The torque produced by the device 50 as the device 50 is rotated in unison with the slats 16–24 is shown in FIG. 6. The mass and spring system of the device 50, FIG. 6, produces a torque with a $\sin 2\theta$ dependence due to the shift of the mass 76 caused by gravity. The mass 76 is permitted to shift in either of directions 37 along shaft 70 parallel to the general plane of the broad surface of the slat 24. The weight of the mass 76 as compared to the spring force produced by the springs 72 and 74 is such that any tilt of the device 50 from a horizontal orientation of the shaft 70 permits a displacement of the mass 76. The shift of the mass center of the mass 76 is proportional to the gravity force component on that mass in a direction parallel to directions 37 along the shaft 70. The gravity force component for mass 76 is $m_w g \sin\phi$, where $\phi$ is $90°-\theta$, $m_w$ is the total mass of mass 76. The magnitude of the shift of the mass 76, $l_w$, is given by $$\frac{m_w g \cos\theta}{k}$$

where k is the spring constant of each of the springs 70, 74. The torque generated by the shifted mass 76 is $l_w\ m_w g \sin\phi$. Since the $l_w$ term is a function of $\cos\phi$, it is apparent that the same $2\theta$ dependence appears in the torque produced by mass 76. Because $\phi$ is $90°-\theta$ the torque produced by the device 50 is proportional to sin $2(90°-\theta)$ and is equal to $-\sin 2\theta$. Thus, the sin $2\theta$ dependence of the torque produced by the displaced mass of the slat 16, FIG. 5, can be cancelled by the $-\sin 2\theta$ dependence of the displacement of the mass 76 of the device 50, FIG. 6.

Since all of the slats 16–24, FIG. 1, are interconnected to a common lever 34, the torques produced by the individual sagging slats are transmitted to their corresponding cranks 28 and thus to the lever 34. Therefore, a single device 50 mounted to one of the slats such as slat 24 can be made sufficient to counterbalance the torques produced by the offset masses of all of the slats.

By proper selection of the spring constants and the weight of mass 76, by minimizing the frictional engagement of the mass 76 to shaft 70 to provide maximum slide of the weight in response to gravity, sagging masses of a given value can be counter-torqued. These parameters are selected in accordance with a given implementation and can be readily selected from materials commercially available. To minimize friction the shaft 70 may be coated with Teflon as is the surface of the opening 78 in the mass 76. Thus, for each angular orientation of the slat such as slats 16–24, a torque is produced by the device 50 which counterbalances the torque produced by the slats. Also, it does not matter which angular direction the slats are rotated. The mass 76 is free to slide in either of directions 37, FIG. 6, in accordance with which way device 50 is tilted. The springs 72 and 74 being of equal spring constants provide equal and opposite effects when the device 50 is tilted in one angular direction as compared to the other.

Figure 7:
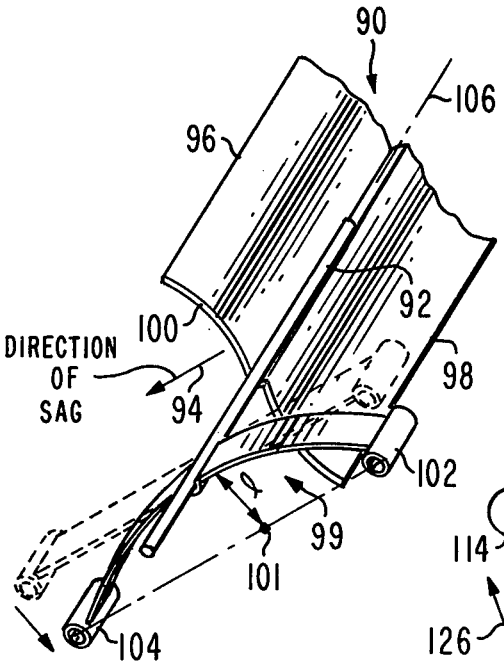
FIG. 7 is an isometric view of a second embodiment of the invention.

A second embodiment of device 50 is illustrated in FIG. 7. In FIG. 7, slat 90 has a shaft 92 at one end about which the slat 90 rotates. It is to be understood that there is another shaft equivalent to shaft 92 at the other end of the slat. Either one of these shafts may be employed to rotatably drive the slat. The direction of sag is given by the arrow 94. This is normal to the broad surface area defined by the edges 96, 98 and the two end edges 100 (only one being shown). Attached to the shaft 92 is a spring device 99. The spring device 99 comprises flat thin spring material which may be an elongated thin strip of rectangular shaped copper or beryllium or similar resilient material which has a natural flat quiescent state as shown dashed. In this quiescent state the spring material is flat and linear. Two equal masses 102 and 104 are attached to opposite ends of the spring. The combined mass center of the two masses 102 and 104 lies along the axis of rotation 106 of the slat 96. The masses 102 and 104 are symmetrically positioned with respect to the axis 106. When in the position as shown dashed, the mass center of the spring device 99 with its two masses 102, 104 lies on the axis 106. A line passing through the mass center of the masses 102 and 104, is normal to the broad surface area of the slat 90. Thus, the line connecting the center of mass of the masses 102 and 104 is parallel to the direction of sag 94.

In operation, when the slat 90 is rotated, for example, to the position as shown in FIG. 7, so that the direction of sag is in direction 94, the two masses 102 and 104 tend, in response to the force of gravity on their respective masses, to displace in a direction normal to the direction 94 as shown in solid line. This causes a displacement of the combined mass center of the masses 102 and 104 from along axis 106, assuming the mass of the spring 99 is negligible, a distance 1 to point 101. The location of the mass center at 101 creates a torque which substantially counterbalances the torque created by the displacement of the mass center of the slat 90 in direction 94 with respect to axis 106.

Figure 8:
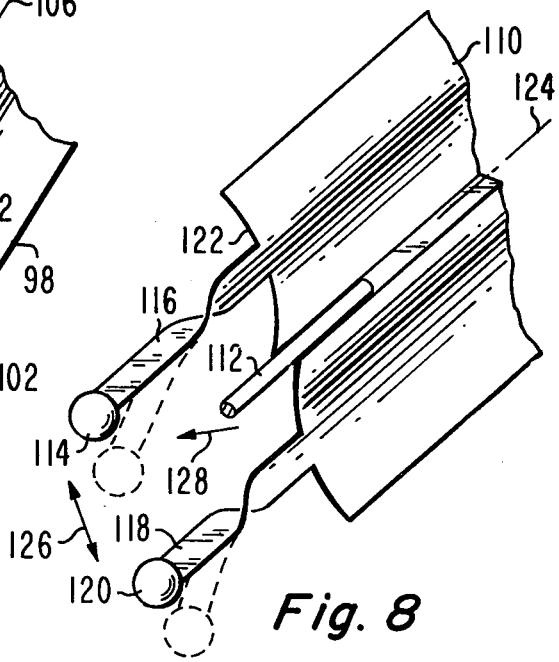
FIG. 8 is an isometric view of a third embodiment of the present invention.

Another embodiment of the invention is shown in FIG. 8 in which a slat 110 is mounted for rotation about a shaft 112 secured at one end and a second shaft at the other end (not shown). Two identical masses 114, 120 are suspended from an edge 122 of the slat 110 by respective twisted identical elongated sheet spring members 116, 118. Mass 114 is on one side of the shaft 112 and mass 120 on the other side. A line through the centers of masses 114 and 120 in the quiescent state, that is, with the broad surface area of the slat 110 horizontal is such that the line passes through the axis of rotation 124 of the slat 110. Spring members 116 and 118 may be formed from the slat material and twisted identically as shown so that the plane of the spring member at the masses 114, 120 is oriented so that the masses 114 and 120 will only displace in directions 126 normal to the direction of sag 128 of the slat 110. Displacement of the masses 114 and 120 is shown by the dashed lines. The displacement of their combined mass centers from axis 124 is a distance sufficient to produce a torque which substantially counterbalances the torque created by the sagging displacement of the slat mass center from axis 124.

When the louver slat is relatively long, for example, one meter, gravity may produce a twist in the slat during rotation. At first when the blade is set horizontally, as shown in FIG. 4, the sag appears at the blade center. When the crank arm is then rotated, the mass at the central sag resists its rotation. Since the drive force produced by the drive means 39, FIG. 1, is relatively large at the slat region near the crank arm, this region tends at first to rotate. The opposite end region would tend to remain stationary. Therefore, the slat tends to twist when driven at one end. If the crank lever 34, FIG. 1, is rotated a little more, the slat region at the opposite end tends to rotate suddenly or jump when the twisting force overcomes the mass sag force. This kind of abnormal motion is undesirable.

It is possible to minimize this sudden jump action using the device 50, FIG. 6. In this case, the device 50 is mounted on the opposite end of the slat from the crank arm side. Since the opposite end region of slats are not joined by a crank arm and arm drive bar, the device 50 is mounted on each slat. In this case the structure of FIG. 8 is relatively simple and suitable for this purpose.

What is claimed is:

1. In a system including a thin sheet material element having a broad surface of relatively large area and extending along a longitudinal axis, said element supported for rotation generally about the longitudinal axis of the element at two spaced locations along said axis near the longitudinal ends of said element, said element being of a thickness and of a material that it tends to sag off of said axis at a position between said locations from a first sag displacement value in a first direction in response to the force of gravity on the mass center of said element when said broad surface is oriented generally normal to the direction of gravity to a second sag displacement value in a second surface orientation direction different than said normal orientation direction, the displacement of said element mass center from said axis caused by said sag creating a first torque about said axis when said element is rotated, the improvement therewith comprising counter-torque means including a movable mass secured to said element, said movable mass being positioned such that the mass center of said movable mass is aligned with said axis when said broad surface is generally normal to the direction of gravity, said counter-torque means including displacement control means coupled to said mass and said element, said control means being configured such that in response to the force of gravity the mass center of said movable mass displaces from said axis in a direction normal to said direction of sag of said element when said broad surface is oriented in said second direction, said movable mass being of a weight and said control means producing a displacement such that said movable mass center displacement creates a second torque about said axis substantially equal to and opposite in sense to said first torque.

2. The system of claim 1 further including bearing means at opposite edges of said element at said spaced locations, said element having a curved cross-section with the curved cross-section extending the length of the element from one of said edges to the other.

3. The system of claim 1 wherein said counter-torque means includes movable mass support means secured to said element and adapted to slidably receive said mass for movement in a path along said normal direction and resilient means coupled to said support means and said movable mass for resiliently urging said mass centrally on said axis when said path is horizontal and for permitting displacement of said movable mass along said path offset from said axis when the path is non-horizontal.

4. The system of claim 1 wherein said counter-torque means includes resilient means for coupling first and second masses to said element on opposite sides of said axis, said masses having a neutral orientation in which their combined mass center is on said axis when said element is generally horizontal and an orientation with the combined mass center offset from said axis when said element is non-horizontal.

5. The system of claim 1 wherein said element produced torque about said axis is proportional to sin $2\theta$ where $\theta$ is the angular displacement of said element about said axis from a horizontal orientation and said dsiplacement control means includes means for permitting said movalbe mass to move in a direction and amount off alignment with said axis in response to the force of gravity on said movable mass to create a torque about said axis substantially equal and opposite to the torque produced by said element.

6. In combination:

an element of a thickness and material which tends to bend a first value in a given direction in response to the force of gravity on the mass center of said element when said element is in one angular orientation and a second different value when in a second different angular orientation;

means for rotatably supporting the element between two spaced points for rotation about an axis from one to the other of said angular orientations, said axis passing through the mass center of said element in the unbent state, said bent element mass center being offset from said axis in a first range of values, each value in said range corresponding to a different angular orientation of said element about said axis, said offset mass center due to bending of the element creating in response to the force of gravity a first torque about said axis having a value in a second range of values corresponding to each said offset values in said first range of values when the element is rotated about said axis; and counter-torque means secured to said element for creating a second torque equal in value and opposite in sense to said first torque value as said element is rotated.

7. The combination of claim 6 wherein said counter-torque means includes a balancing mass coupled to said element, the mass center of said balancing mass being aligned with said axis when the element mass center is vertically aligned with said axis in one of said angular orientations, and means coupled to the element and balancing mass for permitting the mass center of the balancing mass to displace in only predetermined directions and predetermined amounts from its alignment with said axis to an offset position with respect to said axis at which said second torque is produced.

8. The combination of claim 6 including a plurality of said element, the axes of rotation of said elements being parallel, the offset mass centers of said elements creating a third torque having a value in a range of values equal to the sum of the individual first torques created by said elements, said counter-torque means having a mass sufficient to create a fourth torque having a value in a range of values equal and opposite in sense to said third torque value.

9. The combination of claim 8 wherein said elements and means for supporting said elements includes means for arranging said elements to operate as a shutter in which each element is adapted to form a slat.

10. In a shutter construction including a plurality of sheet material slats secured for rotation about parallel axes, said slats each being rotatably supported at its respective ends, each said slats having a weight and thickness tending to cause each slat to sag between said ends in a first direction generally normal to the broad surface of said sheet material in response to the force of gravity on the mass center of that slat to thereby displace that slat mass center from its corresponding axis, said displaced slat mass center in response to the force of gravity tending to produce a torque on that slat with respect to the slat's axis as the slat is rotated about that axis, the torque having a value in a given range, each value of the torque corresponding to a given angular orientation of that slat, the improvement therewith comprising resilient means including a movable mass of a given weight coupled to at least one of said slats and responsive to gravity such that said movable mass displaces in a second direction off an axis parallel to said slat axes, said movable mass weight being such that when displaced in said second direction substantially counterbalances all said torque values in said range of values with respect to said slat axes.

* * * * *